US005255813A

United States Patent [19]

Berggren et al.

[11] Patent Number: 5,255,813

[45] Date of Patent: Oct. 26, 1993

[54] OPENING ARRANGEMENT FOR A CONTAINER PACKAGE

[75] Inventors: Göran Berggren, Staffanstorp; Ulf Nedstedt, Eslöv, both of Sweden

[73] Assignee: Tetra Alfa Holdings S.A., Pully, Switzerland

[21] Appl. No.: 937,678

[22] Filed: Sep. 1, 1992

[30] Foreign Application Priority Data

Sep. 4, 1991 [SE] Sweden ..... 9102533

[51] Int. Cl.[5] ..... B65D 41/04

[52] U.S. Cl. ..... 220/278; 215/202; 215/209; 215/250; 215/254; 229/125.14

[58] Field of Search ..... 215/250, 254, 202, 209, 215/249, 252, 257; 220/278; 229/125.14, 125.15, 123.2

[56] References Cited

U.S. PATENT DOCUMENTS

| | | | |
|---|---|---|---|
| 2,438,299 | 3/1948 | Relis | 220/278 |
| 3,339,812 | 9/1967 | Meissner . | |
| 4,588,098 | 5/1986 | Uzdy | 215/250 |
| 4,747,499 | 5/1988 | Gach et al. | 215/250 |
| 4,754,889 | 7/1988 | Debetencourt | 215/250 |
| 4,782,646 | 11/1988 | Nantin . | |
| 4,792,053 | 12/1988 | Towns et al. | 215/250 |
| 4,793,503 | 12/1988 | Towns et al. | 215/250 |
| 4,793,505 | 12/1988 | Towns et al. | 215/250 |
| 4,813,578 | 3/1989 | Gordon et al. | 229/125.14 |
| 4,898,293 | 2/1990 | Morel | 215/250 |
| 4,907,722 | 3/1990 | Ueda et al. | 220/278 |
| 5,082,136 | 1/1992 | Schumann | 220/278 |

FOREIGN PATENT DOCUMENTS

| | | | |
|---|---|---|---|
| 0039374 | 11/1981 | European Pat. Off. . | |
| 0247645 | 12/1987 | European Pat. Off. . | |
| 0252532 | 1/1988 | European Pat. Off. . | |
| 0326641 | 8/1989 | European Pat. Off. . | |
| 65165 | 1/1956 | France | 220/278 |
| 531816 | 3/1953 | Italy | 220/278 |
| 87/06220 | 10/1987 | PCT Int'l Appl. . | |
| 2166718 | 5/1986 | United Kingdom . | |
| 2230520 | 10/1990 | United Kingdom . | |

*Primary Examiner*—Gary E. Elkins

*Attorney, Agent, or Firm*—Burns, Doane, Swecker & Mathis

[57] ABSTRACT

An opening arrangement for laminated container packages or cartons of the single-use disposable type is disclosed. The opening arrangement includes an inner pouring spout, which is formed as a closed part continuous with the container package, and an outer, screw stopper-like sealing portion. The outer sealing portion consists of an outer, left-hand threaded part, an inner, right-hand threaded portion, and a pull-off ring disposed therebetween. Penetration devices are provided in the inner part of the outer sealing portion for cutting off a portion of the inner pouring spout when the container package is opened.

13 Claims, 3 Drawing Sheets

OPENING ARRANGEMENT FOR A CONTAINER PACKAGE

TECHNICAL FIELD

The present invention relates to an opening arrangement for container packages, comprising a sealing portion which inflexibly engages with and surrounds a pouring spout, whose end facing away from the container package consists of a continuous, liquid-tight material layer which is shaped in accordance with the inner configuration of the sealing portion.

BACKGROUND OF THE INVENTION

Container packages or cartons of the single-use disposable type are largely employed today to pack consumer goods such as, for example, beverages like milk or juice. The container package is usually made from packaging material in the form of a laminate with carrier layers of paperboard or cardboard, and different layers of thermoplastic laminated thereto. The laminate may also have a different core material, such as metal foil. The packaging material, which is often in the form of a web or sheet blank, is folded, sealed and finally formed into a liquid-tight container package.

The finished container package will preferably include an opening arrangement that is simple to open and pour from, which pours the liquid contents in a compact jet and without any risk of spilling or dripping. However, container packages manufactured from a packaging material consisting of a paper laminate may be difficult to tear open and fold to form a functional pouring spout. Moreover, when the intention is to reclose and reseal such container packages, it is not possible to make the package liquid-tight once again.

It is also known in the art to manufacture container packages having a main portion formed from a packaging laminate as described above but having an upper defining surface formed from an injection molded thermoplastic lid. The thermoplastic lid also includes an opening arrangement integral with the lid. This opening arrangement is relatively easy to open but is not liquid-tight on reclosure and resealing.

In order to obviate the above-outlined drawbacks, various forms of penetrating screw stoppers or plugs have been produced which are placed on the surface of the container package so that the screw plug penetrates through the surface layer when the package is opened.

It is further known in the art to form a partly integrated pouring spout from the surface of the packaging material. The pouring spout is surrounded by a sealing portion of the so-called screw stopper or plug type which, on being opened, tears off an outer portion of the pouring spout. That part of the pouring spout which is torn off during the opening operation has been sealed against the outer sealing portion by means of heat. As a result, the tear-off operation generally results in the pouring spout having a rough outer edge, which may render pouring of the contents enclosed in the container package difficult.

Not all of the prior art types of screw stopper opening are provided with an arrangement which prevents the unauthorized opening of the container package. Today, consumers greatly appreciate an opening arrangement in which it may immediately be seen that no unauthorized person has been able to open the container package and tamper with its contents. It is, therefore, desirably that a screw stopper or plug also include an arrangement which prevents the unauthorized opening of the container package.

OBJECTS AND SUMMARY OF THE INVENTION

One object of the present invention is to provide an opening arrangement for container packages which, on opening, forms an aperture of the pouring spout with smooth edges.

A further object of the present invention is to device a screw stopper or plug which ensures that the consumer will be able to see that the container package has not been subjected to unauthorized opening.

These and other objects have been attained according to the present invention in that the opening arrangement of the type described by way of introduction includes a sealing portion having an inner, right-hand threaded part which is closed at the top, and an outer, left-hand threaded part in an upper region of which are provided at least two penetration devices oriented inwardly in the pouring spout.

BRIEF DESCRIPTION OF THE DRAWINGS

A preferred embodiment of the present invention will now be described in greater detail hereinbelow with particular reference to the accompanying Drawings, in which.

The Drawings show only those details essential to an understanding of the present invention.

DESCRIPTION OF PREFERRED EMBODIMENT

Figure 1:
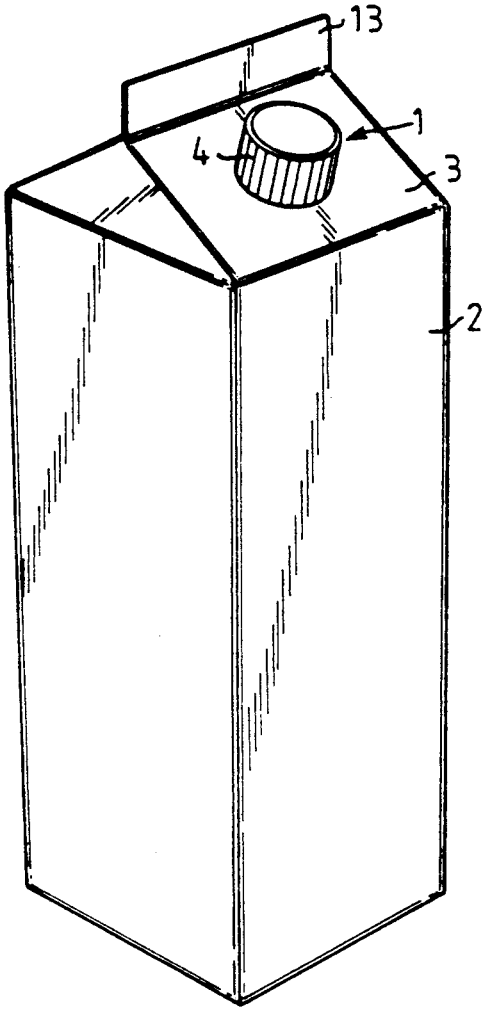
FIG. 1 is a perspective view of an opening arrangement according to an embodiment of the present invention in a container package of known type.

FIG. 1 shows an opening arrangement 1 according to the present invention applied to a container package 2 of known type. The container package 2, which is manufactured from a laminate with a core of paper, cardboard or metal to which is laminated different layers of thermoplastic, is folded, sealed and formed into a so-called gable-top carton 2. The opening arrangement 1 is placed on one of the upper defining surfaces 3 of the carton 2 forming a so-called gable-top. FIG. 1 shows only the outer sealing portion 4 of the opening arrangement 1, this portion being formed as a screw stopper of substantially conventional type, with interior threading, or alternatively a snap top with an inner bead (now shown).

Figure 2:
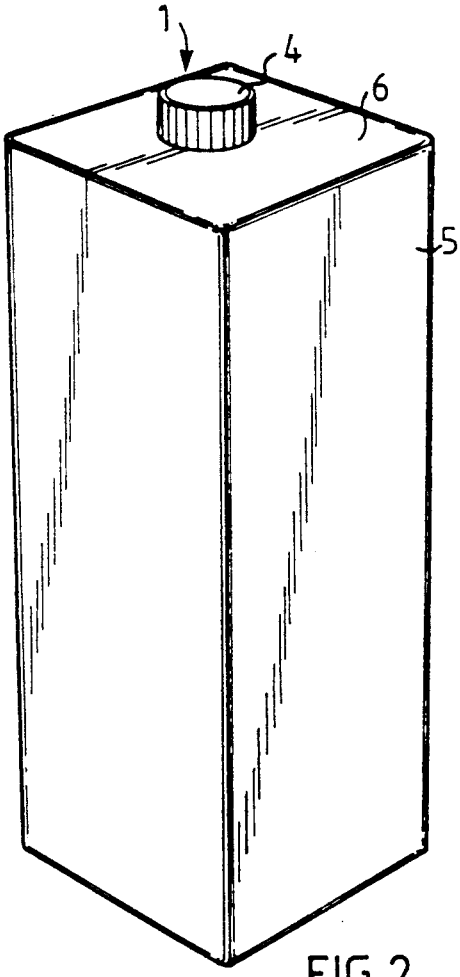
FIG. 2 is a perspective view of the opening arrangement according to an embodiment of the present invention in another type of container package.

FIG. 2 shows another type of container package 5 also of known type in which the lower portion of the container package 5 is manufactured from a laminate in accordance with the above description. The upper defining surface 6 of the container package 5 is formed from a thermoplastic panel, part of the surface of which has been formed into a pouring spout surrounded by an outer sealing portion 4. The remaining parts of the thermoplastic panel are folded about the upper edge of the container package 5 and are sealed by means of heat against the thermoplastic surface of the packaging laminate.

Figure 3A:
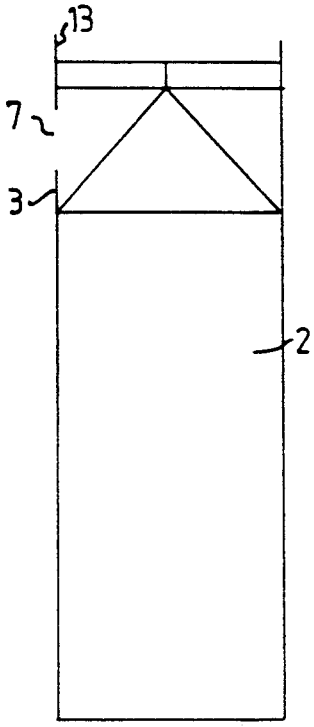
FIGS. 3A–3E are schematic, partially cross-sectional views depicting the application of an opening arrangement according to an embodiment of the present invention is applied to a container package such as is shown in FIG. 1.
Figure 3B:
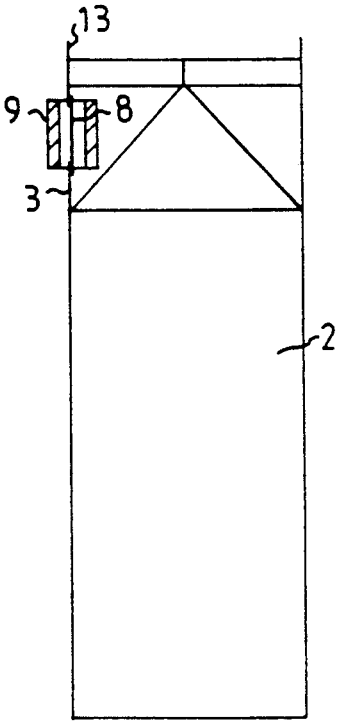

FIGS. 3A–3E schematically show how an opening arrangement 1 according to the present invention is applied to a container package 2 such as is shown in FIG. 1. As is seen in FIG. 3A, a circular opening 7 is formed in one of the upper sloping gable-top panels 3 of the container package 2. A thermoplastic panel 8 is placed inside the circular opening 7, this panel having a diameter which exceeds that of the circular opening 7 in the wall surface 3 of the container package 2. As shown in FIG. 3B, the thermoplastic panel 8 is sealed interiorly against the inner wall surface of the container package 2 by means of a sealing tool 9.

Figure 3C:
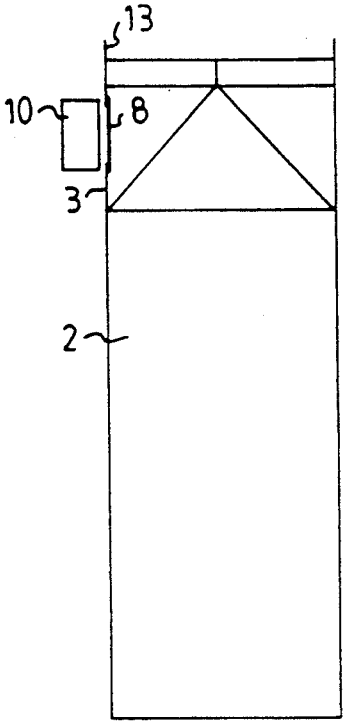
Figure 3D:
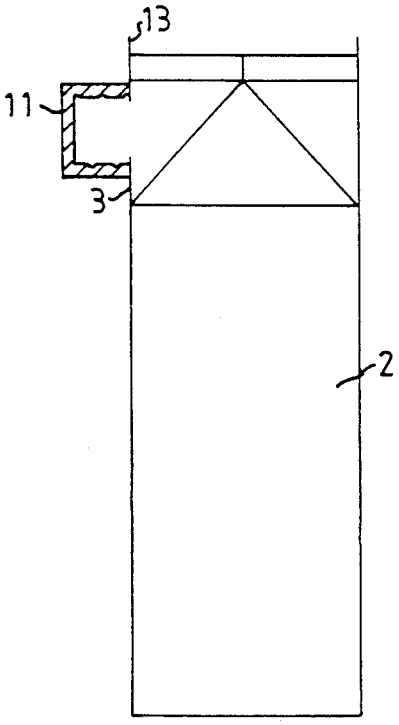
Figure 3E:
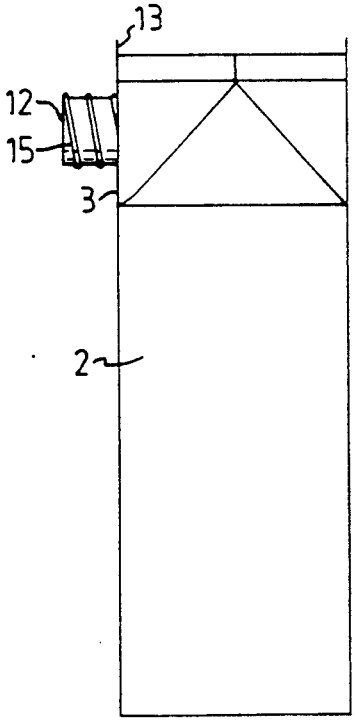

In FIG. 3C, the thermoplastic panel 8 is heated by a heated 10 to a temperature at which the thermoplastic plasticizes (for polyethylene approx. 110° C.) Once the thermoplastic panel 8 has become plasticized and pliable, it is subjected to vacuum or pressure forming in a molding tool 11 as illustrated in FIG. 3D. The outer sealing portion 4 is preferably used as the mold for vacuum forming the pouring spout 12 with threads 15. FIG. 3E finally shows the finished pouring spout 12 provided with threads 15. The pouring spout 1 is completely sealed and constitutes a liquid-tight part of the container package 2 when the outer sealing fin or flap 13 is finally sealed together after the filling operation.

Figure 4:
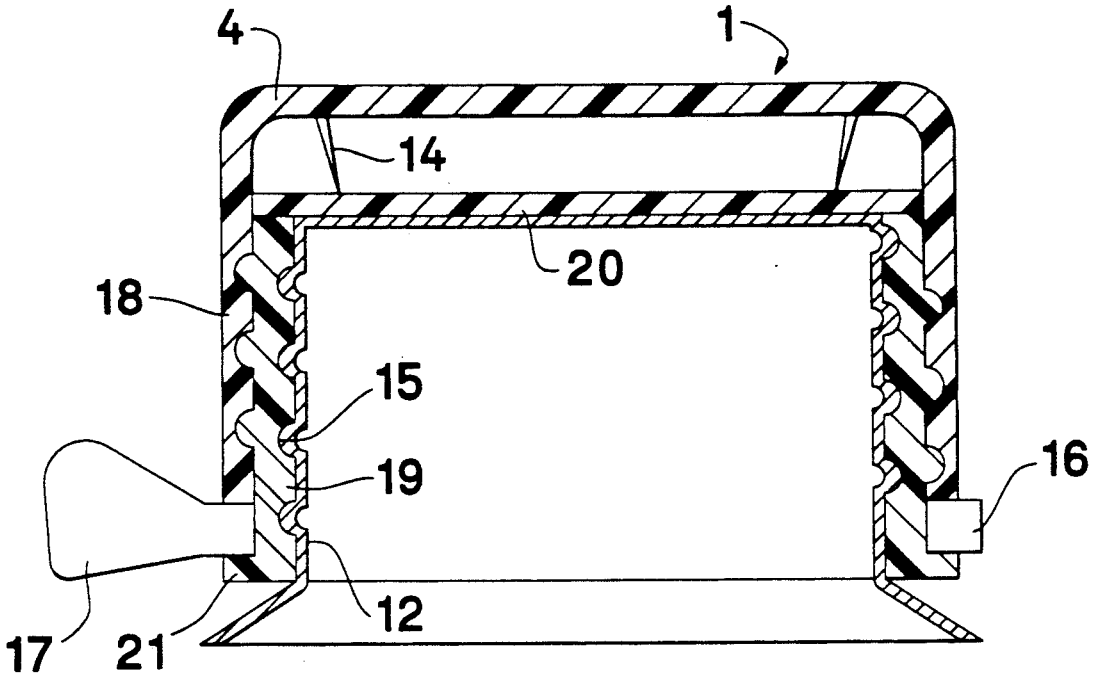
FIG. 4 is a partially cross-sectional side view of an opening arrangement according to an embodiment of the present invention in an unopened state.

FIG. 4 shows the opening arrangement 1 according to the present invention in that state in which it is to be found on the carton 2 when the consumer first handles it. As a result of the ring 16 which is fixed or sealed to the outer sealing portion 4, the consumer is guaranteed that no one can have tampered with or unrightfully opened the carton 2. The ring 16, which is made of plastic material, can be provided with a thumb grip 17 in order to facilitate grasping of the ring for tearing-off. Of course, the opening arrangement 1 may also be manufactured without the ring 16 but those advantages afforded by the ring 16 from the point of view of the consumer will then be lost.

The outer sealing portion 4 consists of two parts, the first being an outer screw stopper-like part 18 which is left-hand threaded. In the upper region of this outer screw stopper like part 18, there are provided at least two, and preferably four penetration devices 14.

The penetration devices 15 preferably are formed in the shape of small bevelled plastic pieces which project out from the inner wall of the outer part 18 of the sealing portion 4. The penetration devices 14 may also be formed of small metal pieces which have been fixed in place.

The sealing portion 4 also has an inner part 19 which is right-hand threaded an fits the threads 15 of the pouring spout 12. This inner part 19 is not of the same height as the outer part 18 but terminates before the penetration devices 14 with a tightly sealing plastic washer 20. The tightly sealing plastic washer 20 serves as a seal for the inner part 19 of the sealing portion 4 and the upper part of the pouring spout 12 is thus formed against this plastic washer 20.

Figure 5:
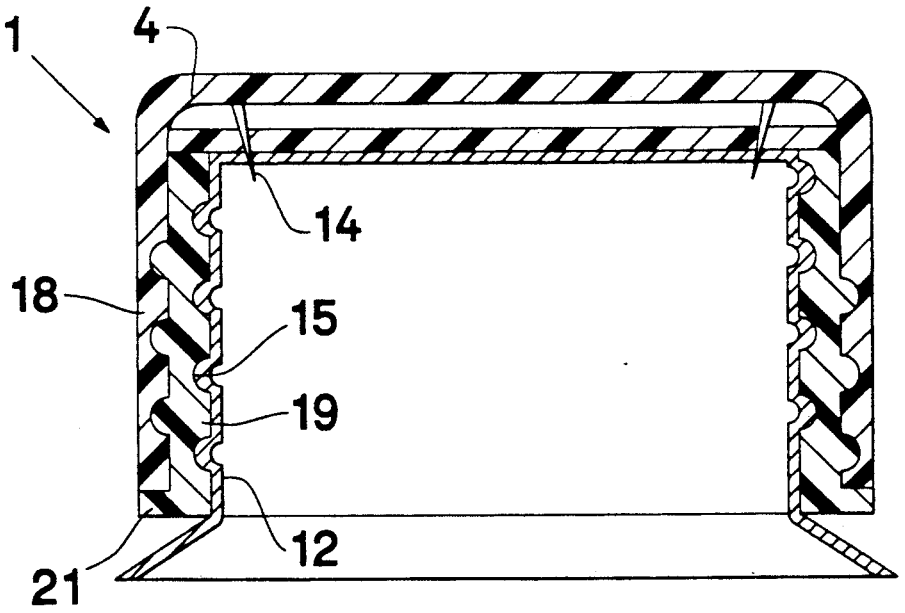
FIG. 5 is a partially cross-sectional side view of an opening arrangement according to an embodiment of the present invention after opening has been instigated.

FIG. 5 shows the opening arrangement 1 according to the present invention once the pull-ring 16 has been removed and the outer part 18 of the sealing portion 4 has been screwed with left-hand turn down to a stop heel 21. This stop heel 21 constitutes a component of the inner part 19 of the sealing portion 4 and is located most proximal the end wall of the container package. As the outer part 18 of the sealing portion 4 reaches this position, the penetration devices 14 cut through the plastic washer 20, which terminates the inner part 19 of the sealing portion 4, at the same time as they penetrate through the upper region of the pouring spout 12. The outer part 18 of the sealing portion 4 is locked in its lower position, for example by plastic barbs (not shown) which are placed between the outer part 18 and the stop heel 21.

Because the penetration devices 14 are placed in such a manner that they are angled slightly in towards the center of the pouring spout, they will, on removal of the outer sealing portion 4, retain the severed portions of the plastic washer 20 and the pouring spout 12. In order further to ensure retention of the severed portions of the plastic washer 20 and the pouring spout 12, a screw (not shown) may be fixed in the inside of the outer part 18 of the sealing portion 4 to penetrate down into the plastic washer 20 and the pouring spout 12 to facilitate retention of the severed portions when the sealing portion 4 is unscrewed from the opening arrangement 1.

The penetration devices 14 should be at least two in number but are four in number in the referred embodiment. The number of penetration devices 14 is dependant upon the length and pitch of the thread 15. The longer the thread 15, the fewer will be the number of penetration devices 14 required. The penetration devices 14 must together be capable of cutting off a complete circular surface of the plastic washer 20 and the pouring spout 12.

As will have been apparent from the above description, the present invention realizes an opening arrangement for conventional container packages or cartons which is simple to open and reseal. The consumer is guaranteed a container package which has not been opened by unauthorized hands and, as a result of the perforation or penetration devices characteristic of the present invention, the user will obtain a pouring spout which makes possible pouring of the contents of the container package without spilling and without dripping.

While this invention has been illustrated and described in accordance with a preferred embodiment, it is recognized that variations and changes may be made therein without departing from the invention as set forth in the claims.

What is claimed is:

1. An opening arrangement for a container package comprising:

an inner sealing portion formed with an interior, right-hand threaded configuration, enclosed at the top, and a left-hand threaded exterior;

an outer sealing portion formed with a left-hand threaded interior conforming with the left-hand threaded exterior of the inner sealing portion, the outer sealing portion being disposed on the inner sealing portion, prior to opening the opening arrangement, such that an upper region of the outer sealing portion is formed between the outer sealing portion and the inner sealing portion;

a pouring spout, a first end of the pouring spout being attachable to a container package, a second end of the pouring spout forming a continuous, liquid-tight part, the pouring spout being formed with a right-hand threaded exterior conforming with the right-hand threaded configuration of the inner sealing portion, the pouring spout being inflexibly engaged with and at least partially surrounded by the inner sealing portion;

at least two penetration devices extending inwardly from the upper region of the outer sealing portion toward the pouring spout.

2. The opening arrangement as set forth in claim 1, wherein the penetration devices are obliquely inclined so that tips of the penetration devices point in toward the pouring spout.

3. The opening arrangement as set forth in claim 1, wherein the penetration devices are four in number.

4. The opening arrangement as set forth in claim 1, further comprising a ring formed with the inner and outer sealing portions and disposed between the inner and outer sealing portions, the ring being secured against the outer sealing portion such that it is necessary to remove the ring before opening of the opening arrangement.

5. The opening arrangement as set forth in claim 1, wherein the outer sealing portion is a screw stopper.

6. The opening arrangement as set forth in claim 1, wherein the pouring spout of the opening arrangement is made of a material which includes thermoplastic.

7. The opening arrangement as set forth in claim 6, further comprising a packaging container, and wherein the thermoplastic material forms a part of an upper end wall of the container package.

8. The opening arrangement as set forth in claim 6, wherein the thermoplastic includes polyethylene.

9. An opening arrangement for a container package, comprising:

a tubular pouring spout having an inlet end adapted to be attached to a container package, and having a helical exterior screw thread;

a tubular inner sealing element portion formed with a helical interior screw thread on an interior side of the inner sealing element that corresponds with said pouring spout exterior screw thread, and formed with a helical exterior screw thread of the opposite direction from the interior screw thread;

a cap having a tubular outer sealing element formed with an interior screw thread which corresponds with the exterior screw thread of the tubular inner sealing element, the tubular outer sealing element being assembled on the inner sealing element, the cap having a top portion;

a disc covering an end of the tubular inner sealing element adjacent the top portion of the cap;

penetration means on the cap for penetrating the disc upon turning the cap in a first direction, the cap being separated from the tubular inner sealing element upon turning the cap in the direction opposite to the first direction.

10. The opening arrangement as set forth in claim 9, wherein the penetration means extends from the top portion of the cap.

11. The opening arrangement as set forth in claim 10, wherein the penetration means includes two or more penetration devices, each penetration device forming an oblique angle to the interior side of the tubular inner sealing element, such that the penetration devices retain the disc upon turning the cap in the first direction.

12. The opening arrangement as set forth in claim 9, further comprising a ring, disposed between the tubular outer sealing element and the tubular inner sealing element such that it is necessary to remove the ring before opening the opening arrangement.

13. The opening arrangement as set forth in claim 9, wherein the pouring spout is formed by vacuum molding material in a mold formed at least in part by the interior side of the inner sealing element.

* * * * *